United States Patent [19]

Stevens

[11] 4,427,505

[45] Jan. 24, 1984

[54] APPARATUS FOR RECOVERING METALS FROM SOLUTION

[76] Inventor: William J. Stevens, 23/25 Woodstock St., Bondi Juncton, New South Wales, 2022, Australia

[21] Appl. No.: 287,732

[22] PCT Filed: Jan. 15, 1981

[86] PCT No.: PCT/AU81/00008

§ 371 Date: Jul. 23, 1981

§ 102(e) Date: Jul. 23, 1981

[87] PCT Pub. No.: WO81/02028

PCT Pub. Date: Jul. 23, 1981

[30] Foreign Application Priority Data

Jan. 17, 1980 [AU] Australia ..... PE2035

[51] Int. Cl.[3] ..... C25C 1/20; C25C 7/00

[52] U.S. Cl. ..... 204/109; 204/269

[58] Field of Search ..... 204/109, 269

[56] References Cited

U.S. PATENT DOCUMENTS

| | | | |
|---|---|---|---|
| 565,953 | 8/1896 | Andreoli | 204/109 |
| 651,396 | 6/1900 | Street | 204/269 |
| 700,941 | 5/1902 | Keith | 204/269 |
| 725,803 | 4/1903 | Turner | 204/269 |
| 1,905,467 | 4/1933 | Hickman | 204/109 |
| 3,524,805 | 8/1970 | Engelman | 204/109 |
| 3,715,291 | 2/1973 | Bentley | 204/109 |
| 3,767,558 | 10/1973 | Rowe | 204/109 |
| 3,926,768 | 12/1975 | Burgess | 204/109 |
| 3,964,990 | 6/1976 | Woyden | 204/109 |
| 4,042,473 | 8/1977 | Lindgren | 204/109 |
| 4,069,127 | 1/1978 | Salemi et al. | 204/229 |
| 4,129,494 | 12/1978 | Norman | 204/269 |
| 4,166,781 | 9/1979 | Staples | 204/109 |

FOREIGN PATENT DOCUMENTS

| | | | |
|---|---|---|---|
| 444212 | 8/1976 | Australia | 204/269 |
| 1445960 | 8/1976 | United Kingdom | 204/269 |

OTHER PUBLICATIONS

"Tanks", Electroplating Engineering Handbook by A. K. Graham et al., Reinhold Pub. Corp., 1955, p. 410.

*Primary Examiner*—R. L. Andrews

*Attorney, Agent, or Firm*—Leydig, Voit, Osann, Mayer and Holt, Ltd.

[57] ABSTRACT

An electrolytic metal recovery unit for extracting silver from a silver rich solution comprises a holding tank for stock solution, an air lift pump to feed solution from the tank to an elevated tundish at a rate causing the tundish to over-flow, a second air lift pump to feed solution from the tundish through a flow control valve to three transparently walled, electrolytic, plating out cells arranged in cascade and means responsive to liquid level in the holding tank to cause the pumps and cells to operate in concert.

14 Claims, 1 Drawing Figure

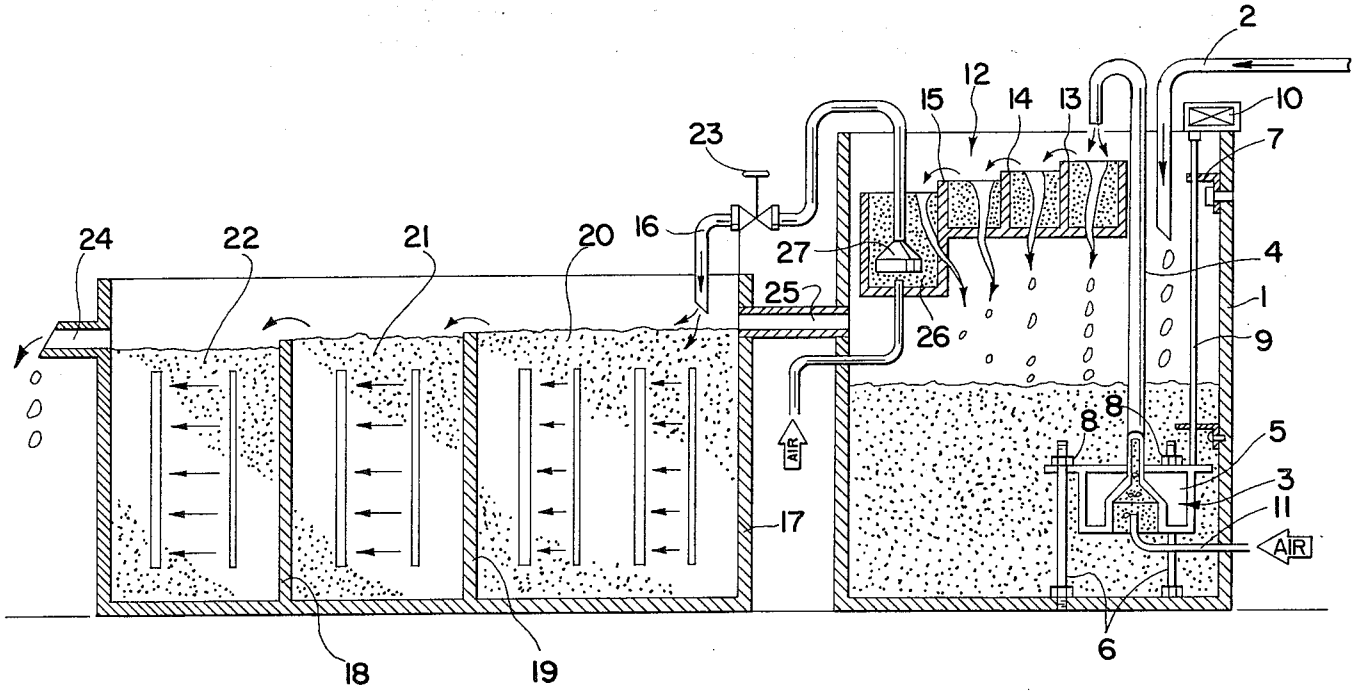
2
10
7
4
1
9
5
3
11
AIR
8
8
6
13
14
12
15
26
27
25
AIR
17
23
16
20
19
21
18
22
24

APPARATUS FOR RECOVERING METALS FROM SOLUTION

This invention relates to the recovery of metals from metal rich electrolytes.

The invention was developed primarily for use in association with automatic photographic film processors for the extraction of silver from the effluent solution from such processors and is described hereinafter primarily with reference to that application. However it will be appreciated that the invention is applicable generally to metal recovery units and not only to units for the recovery of silver.

Two types of recovery units are commonly used in associated with film processors, namely, the continuous, or flow through type, and the batch type. In one known form of the continuous type unit the metal rich solution is fed into the bottom of a plating-out cell and allowed to rise gently through that cell during which progress the metal is electrolytically plated onto electrodes utilizing a low current density. Another known continuous type unit employs agitation of the electrolyte which causes total mixing and may be operated at a somewhat higher current density. In both instances the depleted solution is discharged from the top of the cell.

As a general rule, the supply of solution from a film processor is not at a constant rate, indeed, depending upon the work load, it is customarily intermittent, the pH of the solution is apt to fluctuate from time to time affecting conductivity, the concentration of silver in the solution is also variable and of course the operation of the recovery unit itself may depart from preset values due, for example, to the deposit of sulphur on the anode thereby reducing the electrical conductivity of the cell and due to the development of faulty electrical contacts between the supply leads and the electrodes as a result of chemical splash and evaporation. Thus completely successful operation cannot be achieved simply by setting the amperage and the electrolyte flow rate in a flow-through type recovery unit to suit the conditions pertaining or anticipated at the start of operations.

That impossibility is recognised in the specification of Australian Pat. No. 444,212 which seeks, by providing an upstream holding tank and by switching the electricity supply to the electrodes on and off in concert with the operation of the metering pump producing flow of electrolyte through the cell, to correct or allow for the intermittent or variable nature of the rate of supply of feed electrolyte. However, this still allows the remaining causes for faulty operation to persist. Thus even with the apparatus described in that patent if, as is usually the case, the effective current has been set to a predetermined constant value, in some instances the current will be less than necessary to extract all, or nearly all, of the silver and the discharged solution may still contain significant quantities of silver.

On the other hand the amperage may be too high, in which event, after all, or nearly all, of the silver has been plated out, other elements, usually sulphur as silver sulphide, will be deposited, thereby undesirably contaminating the silver deposit. In more extreme cases of over-extraction, sulphur deposits will cover the anode causing a decrease in electrode efficiency, lowering the amperage and reducing the extraction rate proportionally.

Another known type of monitor which seeks to deliver a predetermined flow of electrolyte through the unit provides for a submersible pump feeding an elevated weir from which a flow control valve regulates the flow of electrolyte to the unit, but even though the electrolyte from the processor which contains free gelatin from the dissolved photographic emulsion, algae and other impurities may be filtered, some still persist and indeed grows within the holding tank where crystals of the salts may also form. These impurities interfere with the operation of the flow control valve even to the point whereby it becomes inoperative. This condition could go unnoticed until the next service were due.

The batch type unit has been developed in attempts to overcome most of the above-indicated deficiencies of the prior known continuous type units. Briefly stated, in a batch type unit, a holding tank is provided to accommodate excess quantities of electrolyte as may be supplied from time to time from the processor. Periodically electrolyte is drawn from that holding tank and delivered into a plating-out cell by way of a float-switch controlled pump or the like which fills the plating-out cell to a predetermined level. Thereafter the plating-out is effected for a predetermined electrolysis time at a predetermined amperage in an attempt to remove all the silver or nearly all the silver from the charge of solution in the cell. Usually the solution is deliberately agitated as the plating-out takes place. Thereafter, the cell is emptied and a fresh charge is taken from the holding tank and the process is repeated.

Thus, in the batch type of apparatus the time for electrolytic extraction proceeds in respect of each charge of solution which is predetermined and all of the silver will be extracted if the two parameters of amperage and time have in fact been set to accord with the nature of the solution being delivered into the plating-out cell. If the time has been over-set or the concentration of silver has decreased or has been over-provided for, an anodic deposit of sulphur occurs as mentioned previously and this state may not be apparent for several months or at least until the equipment is opened up for the regular removal of the silver. When sulphur deposits on the anode, reverse electrolysis is taking place and the silver sulphide deposit on the cathode is being eroded and lost to the effluent.

Batch type units are a considerable advance on prior known continuous types but they are considerably more costly because of the fairly elaborate switching and pumping arrangements required and their success depends on the correct assessment of the silver content of the incoming solution by the technician when setting the extraction time and amperage.

With the foregoing in mind, the objects of the present invention are to provide metal extraction apparatus which overcomes or at least ameliorates the difficulties of the prior known continuous type units, is inherently somewhat less expensive than the prior known batch type units and which permits simple checking of its operating conditions enabling an operator (not necessarily a technician or highly skilled worker) to adjust the amperage and/or the electrolyte flow rate through the unit to suit the feed material and to obtain substantially complete extraction of the metal with a desirably low level of contamination with sulphur or other contaminants.

The present invention is based on the recognition that the critical conditions in respect of which the operating parameters have to be very accurately set occur in the main when there are low concentrations of metal remaining in the electrolyte.

Thus, in the case of a batch type unit extracting silver from spent photographic solutions the majority of the deposited silver will be substantially uncontaminated during the first 80 to 85% of the extraction cycle and will be likely to be slightly contaminated with sulphur only during the balance of extraction up to about 97% of the total but thereafter, unless extremely low current densities are employed, is likely to be seriously contaminated with sulphur. Furthermore, if over-extraction occurs then reverse electrolysis will occur and reduce and foul the recovered silver deposit. Similarly, in prior known continuous type units the critical conditions operate, as it were, continuously because of the requirement that the effluent electrolyte be substantially devoid of silver at all times.

The present invention recognises the foregoing and replaces the single cell previously used in both types of units with a multi-cell cascade arrangement in which the spent electrolyte from cells of higher order constitute the feed material for cells of lower order. Thus in a three-cell system according to the invention, for example, 85% of the silver in the electrolyte received from the film processor may be plated out under relatively non-critical conditions in the first cell of the cascade, a further say 12% may be plated out in the centre cell of the cascade leaving only 3% for plating-out under critical conditions in the final cell of the cascade.

In such instance the deposit in the first cell may be cream or very light grey and will be almost pure silver, the deposit in the centre cell may be the slightly darker grey of silver with an acceptable sulphur contamination. Ideally the still darker deposit in the third cell may be acceptable insofar as contamination is concerned but in any event if conditions are not ideal it is only that final 3% of the silver deposited which is likely to be affected.

Furthermore the use of three or more cells in cascade facilitates accurate setting of the apparatus to suit the infeed solution by visual inspection of the nature of the deposits and the colour of the electrolytes in the respective cells and their comparison one with the other. Also any tendency for sulphur to form on the anodes of lower order cells is readily observed. Such visual inspection may be backed-up by testing for the silver concentrations in the electrolytes of the last and second-last cells. Ideally there should be a maximum concentration of silver in the electrolyte of the second-last cell compatible with a creamy deposit in the first cell and compatible with zero silver in the effluent from the last cell. A testing procedure enabling the operator to arrange for those conditions to apply will be described in more detail hereinafter.

Therefore, the invention consists in an electrolytic metal recovery unit of the continuous type comprising at least three plating-out cells arranged in cascade.

The term "arranged in cascade" indicates that the electrodes of all the cells are electrically in parallel or otherwise have similar operating voltages applied to them at all times, and that the cells are disposed in sequence with electrolyte flowing from one cell to the next lower cell in the sequence until the last cell is reached which discharges to waste.

It follows that, in steady state operation, the metal concentration of the electrolyte decreases from cell to cell in the direction of electrolyte flow.

By way of example an embodiment of the above-described invention is described hereinafter with reference to the accompanying FIGURE, which is a diagrammatic longitudinal sectional view of a metal recovery unit in accordance with the present invention.

The illustrated unit comprises a holding tank 1 to receive silver rich electrolyte feed solution from a photographic processor by way of input duct 2 extending to the electrolyte outlet of the processor (not shown).

The holding tank 1 houses an airlift pump 3 comprising a lifting tube 4 supported by a generally bell-shaped float 5. The entire pump 3 may rise and fall on guides 6 and 7. It is illustrated at the upper extremity of its travel as determined by the adjusting nuts 8 on guides 6, but if the level of the electrolyte in the holding tank 1 falls sufficiently, the pump will descend to carry push-rod 9 with it so as to break pressure contact between the upper end of push-rod 9 and the operating button of a normally open microswitch 10.

The float 5 has a cavity in its undersurface in communication with the bore of the lifting tube 4 and air introduced into that cavity by air-supply tube 11 extending to an electric, vibrator-type, air compressor (not shown) enters the tube 4, thereby reducing the effective density of the liquid in the tube and thus causing upward flow of solution through the tube. The microswitch 10 controls the electric supply to the air compressor and thus switches off the pump 3 when the level of solution in the holding tank 1 drops to a predetermined minimum level. The pump 3 discharges into a tundish 12 divided by internal baffles 13, 14 and 15, respectively, into four compartments. The baffles are of successively lesser height so that the compartments are in cascade.

Each of the baffles is very slightly less in height than the side walls of its immediately upstream compartment. Thus, solution flows over the baffles from one compartment to the next whilst froth and surplus solution flows over the side walls of the tundish as indicated by the arrows in the drawing. The overflow from each compartment diminishes from higher to lower compartments as indicated by the falling drops.

The end result is that the liquid level in the lowermost compartment 26 is substantially unvarying and the liquid in that compartment is substantially unaerated.

The compartment 26 houses a second airlift pump 27 and from the foregoing it will be appreciated that the pump 27 has a constant submergence level so that the output of the pump is at a constant rate. The output from this pump 27 flows to a flow control valve 23 but because of the inherent characteristics of an airlift pump, the solution and air is discharged explosively once the force of air overcomes the weight of air and liquid in the pump feed tube, and this has a scarifying effect on the valve control surfaces and indeed within the tubes themselves sufficient to dislodge any crystals or other foreign bodies which may otherwise form and interfere with the efficient operation of the valve 23 and alter its preset flow rate. Thus, the provision of pump 27 is greatly preferred but in the interests of economy it may, in some embodiments of the invention, be dispensed with, in which event the valve 23 would be in direct communication with the interior of compartment 26 by way of an appropriate drain tube from that compartment.

From this valve 23 solution flows by transfer tube 16 into a plating-out tank 17 divided by partitions 18 and 19 into three plating-out cells 20, 21 and 22. Cell 20, being the first of the three cell cascade receives the electrolyte from the tube 16, and does so at a rate which is controlled by the adjustable valve 23.

Cell 20 contains more sets of electrodes than does either of cells 21 and 22, but the electrodes of all the cells are connected in parallel so that they all operate contemporaneously. The supply to the electrodes is controlled by the microswitch 10 so that electrolysis proceeds only for so long as the pump 3 is operating, that is to say only when electrolyte is flowing through the cells. Cell 22 discharges its effluent through outlet 24 to waste.

An overflow conduit 25 is provided to meet a contingency situation if the in-flow of electrolyte via pipe 2 exceeds for a substantial period of time the rate at which it can be processed by the unit under optimum conditions so that the level of electrolyte in holding tank 1 rises to the height of conduit 25. In that event a flow through the conduit 25 occurs to prevent holding tank 1 from over-filling; but of course the rate of flow through the plating-out cells is then higher than optimum and some silver would be lost in the effluent from cell 2.

Tanks 1 and 17 may be manufactured from suitably corrosion resistant materials such as fibre reinforced resins, polypropylene or other plastics. However, in accordance with preferred embodiments of the invention at least a wall or part of a wall of each of the cells 20, 21 and 22 is made of a transparent material such as glass. Indeed for preference, the entire tank 17 and its partitions may be glass or other suitable transparent material. This enables an operator to observe the colour and nature of the deposit on the various electrodes and the colour of the electrolyte in the respective cells.

The three cells provide a convenient method of control of the illustrated embodiment of the invention not hitherto available in respect of single cell units. Briefly stated, the unit will be operating satisfactorily if there is no silver present in the effluent from cell 22 provided there is some present in the electrolyte in cell 21. If the concentration of silver in the electrolyte of cell 21 is kept at its highest level, compatible with the effluent from cell 22 showing no trace of silver, then the setting of the extraction rate and the electrolyte flow rate is ideal and could not be improved by the most precise analytical methods. On the other hand if cell 21 shows no trace of silver in its electrolyte then clearly over-extraction is taking place in the system.

The above ideal condition is closely approximated if the deposit on the electrodes in cell 20 is creamy or very light grey and therefore virtually pure silver, if the deposit on the electrodes in cell 21 is a slightly darker shade but by no means black, showing a slight contamination with sulphur at a tolerable level and if the deposit on the electrodes in tank 22 is still darker indicating that little silver is being plated out in that cell.

If appropriately coloured deposits are present, the conditions are quite good, however a more precise adjustment may be made following a qualitative test conducted by drawing a small aliquot of electrolyte (about 5 milliliters) from cell 21 and gently adding to it a small amount of dilute sodium sulphide (0.5 to 1 milliliter) which will form a silver sulphide precipitate, in the small band on top of the remainder of the aliquot, which remainder still has the inherent colour of the sample and is thus useable for comparison purposes, if silver is present. The colour of the precipitate is in proportion to the amount of silver present. This system of precipitation is used in an approved laboratory technique for preparing samples for colormetric analysis of photographic chemicals, but normally the sample has to be diluted to a 2% solution or in some cases to a 1% solution. This is because at higher concentrations the precipitate is quite black and dense and the various shades of mahogany down through dark and light amber to light straw are not apparent. If any silver is present at all the slightest discolouration is observable but in any of the concentrations which may be expected in cell 21 a readily observable and gradable coloured precipitate is encountered without any preparation of the electrolyte sample. The various shades of amber of the precipitate change to a very obvious degree in the low concentrations such as will be found in cell 21 and once the optimum conditions have been established, that is the darkest shade of amber which can be obtained by adjustment of the plating rate (which by virtue of the parallel arrangement of the electrodes in the three cells adjusts all cells proportionately) compatible with no trace of colour being apparent in the precipitate of a corresponding test on electrolyte drawn from cell number 22, the colour of the precipitate in cell 21 may be memorised. After a little practice it will be found that an operator need make no further tests in respect of cell number 22 because the maintenance of the memorised shade of precipitate in cell 21 means that some silver is going into cell 22 but no silver could be leaving it and complete control of the whole system may thereby be achieved by a simple test on the electrolyte in cell 21.

As indicated above, the primary purpose for utilising a cascade of three or more cells in a metal recovery unit, particularly a silver recovery unit, is to facilitate the control of the operation of the unit. However, a further advantage flows from the invention when applied to the recovery of silver from a film processor effluent, in that it becomes possible to draw electrolyte from a lower order cell—particularly if more than three cells are provided—having an electrolyte with a sufficiently low silver content to be suitable for return to the film processor, for re-use as a proportion of the feed solution to the processor.

If desired the lower order cell concerned may be devoid of electrodes and may house a metering pump operating in concert with the unit as a whole to return a proportion of the electrolyte entering that cell to the film processor.

Although the silver is the main contaminant and it will have been substantially eliminated from the drawn-off electrolyte it may be necessary to modify the chemical composition of the raw make-up solution to produce the correct chemical composition in the feed solution produced when that raw solution is mixed with the drawn-off electrolyte.

I claim:

1. An electrolytic metal recovery unit of the continuous type for recovering metal from a metal rich electrolyte comprising at least three plating-out cells arranged in cascade and having means connecting the cells for supplying spend electrolyte from cells of higher order as the feed material for cells of lower order and means to operate said cells at similar voltages, the cell of highest order having a greater number of electrode sets than any succeeding cell.

2. A unit according to claim 1 wherein at least one wall of each cell is formed at least in part from transparent material to enable the deposits on the electrodes in each cell to be observed.

3. A unit according to claim 1, further comprising a holding tank for in-coming electrolyte to be treated and pump means for delivering electrolyte from the holding tank to the first cell of the cascade at a steady rate.

4. A unit according to claim 3 wherein said pump means comprises a primary air-lift pump, an elevated tundish having an over-flow weir, a delivery tube leading from the tundish to the first of said at least three plating-out cells and a valve whereby the flow through said delivery tube may be adjusted.

5. A unit according to claim 4 wherein solution flow through said delivery tube is effected by a further secondary airlift pump disposed within the tundish.

6. A unit according to claim 5 wherein said tundish is divided by successively shorter baffles into a plurality of juxtaposed compartments arranged in cascade, from each of which compartments surplus solution may overflow in part to the next adjacent compartment and in other part to said holding tank, and wherein said secondary airlift pump is disposed within the lowest compartment in the cascade.

7. A recovery unit according to any one of claims 3 to 6 wherein control means responsive to the level of electrolyte in the holding tank simultaneously activates the pump means and the electricity supply to the plating-out electrodes whenever the depth of electrolyte in the holding tank ecxeeds a predetermined magnitude.

8. A method of controlling the operation of a unit according to any one of claims 1–6, comprising the steps of adjusting the current to the electrodes and the electrolyte flow rate through the cells to obtain a condition wherein there is a maximum concentration of metal in the electrolyte of the second-last cell of the cascade compatible with zero concentration of metal in the electrolyte of the last cell of the cascade.

9. A method of controlling a recovery unit according to any one of claims 1 to 6 when extracting silver, comprising the step of adjusting the current to the electrodes and the electrolyte flow rate through the cells to obtain a condition wherein the colour of the deposit on the electrodes in the respective cells differs each from each becoming successively darker in the downstream direction compatible with the second-last cell of the cascade being a predetermined colour; that predetermined colour being the colour observed during operation of the unit when being controlled by a method according to claim 8.

10. A method according to claim 9 when the unit is extracting silver wherein the current or electrolyte flow rate is adjusted according to the concentration of silver in each cell as determined by a test on an aliquot from each cell with the addition of a small amount of dilute sodium sulphide to produce a precipitate of silver sulphide the shade of which is indicative of the concentration of silver remaining in that cell.

11. An electrolytic metal recovery unit of the continuous type for recovering metal from a metal rich electrolyte comprising at least three plating-out cells arranged in cascade and having means connecting the cells for supplying spent electrolyte from cells of higher order as the feed material for cells of lower order; a holding tank adapted to contain electrolyte introduced to said unit; and a pump means for transferring electrolyte from the holding tank to the first of said at least three cells at a steady rate, said pump means comprising an elevated tundish divided into a plurality of juxtaposed compartments by successively shorter baffles, which compartments are arranged in cascade to permit surplus solution to overflow in part to the next adjacent compartment and in other part to said holding tank, a primary airlift pump arranged between said holding tank and the first of the compartments, a delivery tube arranged between the tundish and the first of said at least three plating-out cells, a secondary airlift pump within the lowest of the compartments and communicating with the delivery tube, and a flow control valve operatively associated with the delivery tube.

12. A unit according to claim 1 wherein said at least three plating-out cells are electrically connected in parallel to one another.

13. A unit according to claim 1 additionally having a means to simultaneously electrically actuate said plating-out cells and to supply electrolyte to the first of said at least three plating-out cells.

14. A unit according to claim 1 wherein the electrolyte is supplied to the first of said at least three plating-out cells by an electrically operated pump means.

* * * * *